US005989095A

United States Patent [19]

Wotton

[11] Patent Number: 5,989,095

[45] **Date of Patent: *Nov. 23, 1999**

[54] DECORATIVE FIGURE ASSEMBLY FROM COMBINATION OF COMPONENT BAGS

[75] Inventor: Michael C. Wotton, Plantsville, Conn.

[73] Assignee: Sun Hill Industries, Inc., Stamford, Conn.

[ * ] Notice: This patent is subject to a terminal disclaimer.

[21] Appl. No.: 08/992,014

[22] Filed: Dec. 17, 1997

Related U.S. Application Data

[63] Continuation-in-part of application No. 08/653,759, May 23, 1996, Pat. No. 5,733,170.

[51] Int. Cl.[6] ..... A63H 3/04; A63H 3/16; B65D 65/00

[52] U.S. Cl. ..... 446/385; 446/73; 446/223; 206/457; 206/575; 428/16

[58] Field of Search ..... 446/73, 385, 221, 446/223; 428/16; 206/457, 575

[56] References Cited

U.S. PATENT DOCUMENTS

| | | | |
|---|---|---|---|
| D. 334,340 | 3/1993 | Parrish et al. | D9/305 |
| 1,379,013 | 5/1921 | Goss . | |
| 2,879,626 | 3/1959 | Gradwohl . | |
| 4,883,441 | 11/1989 | Byer | 446/99 |
| 4,884,991 | 12/1989 | Terzian | 446/369 |
| 5,195,638 | 3/1993 | Zinbarg | 206/457 |
| 5,211,996 | 5/1993 | Zinbarg | 427/16 |
| 5,215,493 | 6/1993 | Zgrodek et al. | 446/372 |
| 5,458,932 | 10/1995 | Zinbarg et al. | 428/16 |
| 5,733,170 | 3/1998 | Wotton | 446/385 |
| 5,776,558 | 7/1998 | Wotton | 428/16 |

FOREIGN PATENT DOCUMENTS

| | | | |
|---|---|---|---|
| 828763 | 2/1958 | United Kingdom | 132/3 |

*Primary Examiner*—Robert A. Hafer
*Assistant Examiner*—Laura Fossum
*Attorney, Agent, or Firm*—David P. Gordon; David S. Jacobson; Thomas A. Gallagher

[57] ABSTRACT

A decorative combination of component bags representing the head, torso, two arms, and two legs of a festive, seasonal, holiday, or non-holiday figure is provided. Each of the bags is comprised of a bag member formed of a flexible waterproof material and has an initially open end. The initially open end is for receiving filler material. A closing means is provided for closing the initially open ends of the component bags. The bags may have fanciful indicia for representing festive, seasonal, holiday, or non-holiday figures. Once assembled, the figure resembles a costumed male or female human, is substantially human-proportioned, and preferably has articulable appendages. The components of the figure may also be supplied in a kit.

37 Claims, 7 Drawing Sheets

FIG. 4(A)
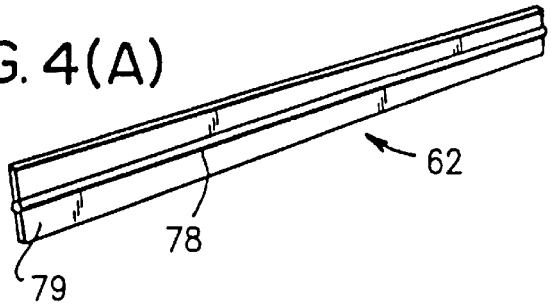
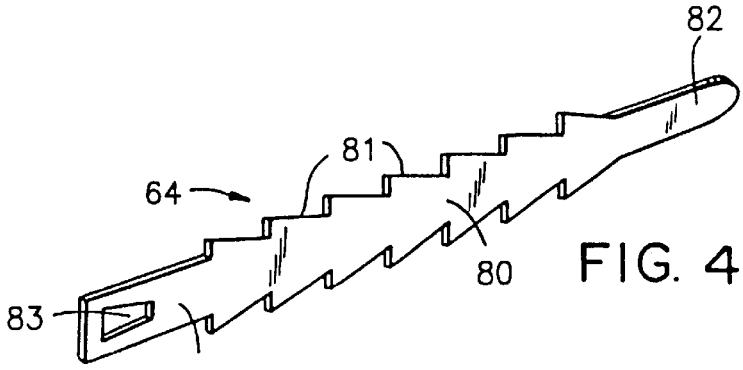
FIG. 4(B)
FIG. 5
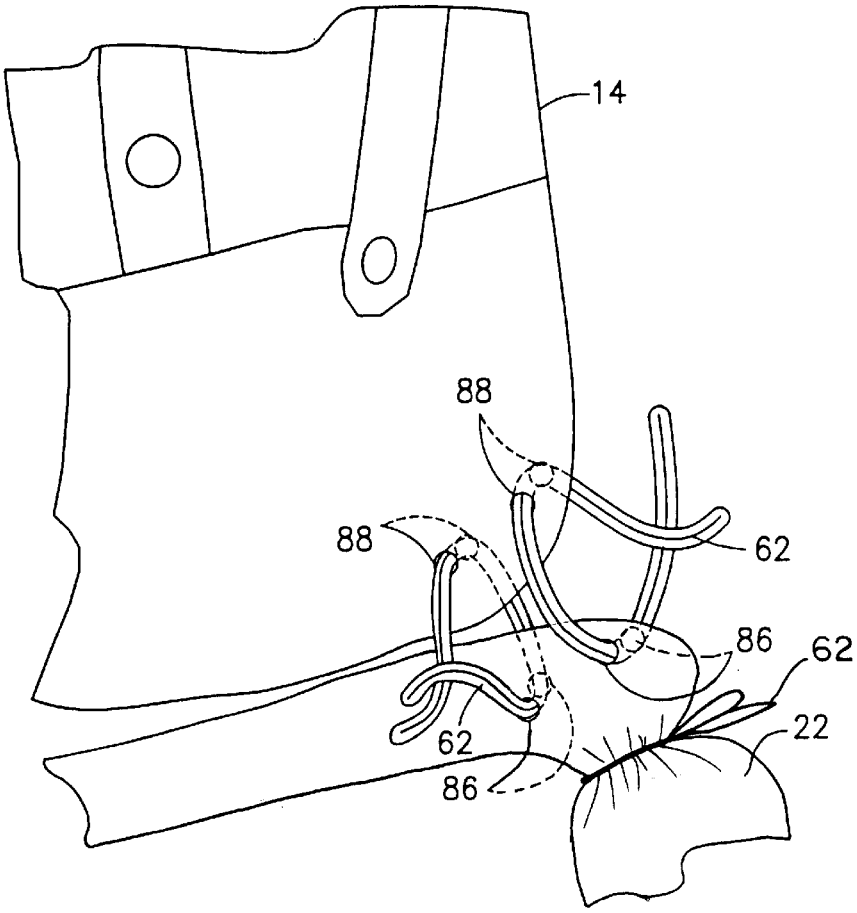

DECORATIVE FIGURE ASSEMBLY FROM COMBINATION OF COMPONENT BAGS

This application is a continuation-in-part of Ser. No. 08/653,759 filed May 23, 1996, now U.S. Pat. No. 5,733, 170, which is related to co-owned Ser. No. 08/427,732 filed Apr. 24, 1995, which is a continuation of Ser. No. 08/276, 773 filed Jul. 18, 1994 and now abandoned, which was a continuation of Ser. No. 07/554,967 filed Jul. 18, 1990 and now abandoned, which was a continuation of Ser. No. 07/384,728 filed Jul. 25, 1989 and now abandoned. This application is also related to Ser. No. 08/635,059 filed Apr. 19, 1996, which is a continuation of Ser. No. 08/261,848 filed Jun. 17, 1994 and now abandoned, which was a continuation-in-part of Ser. No. 07/891,398 filed May 29, 1992, now issued as U.S. Pat. No. 5,458,932, which was a continuation-in-part of Ser. No. 07/749,165 filed Aug. 23, 1991, now issued as U.S. Pat. No. 5,195,638, which was a continuation-in-part of Ser. No. 07/644,023 filed Mar. 4, 1991, now issued as U.S. Pat. No. 5,211,996, which was a continuation of Ser. No. 07/554,967 filed Jul. 18, 1990 and now abandoned; all of which are hereby incorporated by reference herein in their entireties.

BACKGROUND OF THE INVENTION

1. Field of the Invention

This invention relates broadly to decorative objects. More particularly, this invention relates to decorative objects having seasonal, holiday or festive indicia which are formed from a combination of component plastic bags which receive filler material.

2. State of the Art

During certain times of the year, holiday, seasonal, and festive decorative objects are very popular. In the fall, around the time of the Halloween celebration, common decorative objects have the image of a jack o'lantern or scarecrow. Following the Halloween celebration, and in the winter months, the image of Santa Claus is everpresent in holiday displays. During the spring, with the approach of the Easter holiday, images of Easter bunnies are often included in decorative displays.

In certain geographic locations during the fall season, leaves are on the ground, and homeowners often rake their leaves and dispose of them in relatively large leaf bags. Except for a new type of leaf bag (the details of which are disclosed in the related application hereto, Ser. No. 07/554, 967) which has recently been sold during the Halloween season to represent or simulate a pumpkin, the known leaf bags are ordinary leaf bags with no particular significance and with no particular decorative value. Indeed, the leaf bags are considered an eye-sore. In addition, except for the bags disclosed in the related applications hereto, garbage or refuse bags are typically not decorative or theme-related, and the stuffing of such bags with leaves, paper or the like for decorative purposes during the holiday seasons has been unknown.

SUMMARY OF THE INVENTION

It is therefore an object of the invention to provide a combination of component plastic bags, which when filled with filler material such as leaves, crumpled newspaper, or the like, and provided with appropriate indicia, simulates a seasonal, festive, holiday, or non-holiday costumed figure.

It is further object of the invention to provide a simple, easy-to-manufacture, easy-to-assembly combination of objects for decorative use, either indoors or outdoors, which simulates a human-sized or human-proportioned costumed figure.

It is also an object of the invention to provide a simple, easy-to-manufacture, easy-to-assembly combination of objects for decorative use, either indoors or outdoors, which may be outfit with clothing and accessories.

In accord with these objects which will be discussed in detail below, the invention broadly comprises a combination of decorative bags representing the torso, head, two arms and two legs of a human which form a seasonal, festive, holiday or non-holiday figure. According to the preferred embodiment, the figure is proportioned and arranged so that it appears to be a costumed human. For example, the figure may represent a scarecrow having a jack o'lantern head (hereinafter referred to as a "PUMPKIN-MAN", a trademark of the assignee hereof).

According to a preferred embodiment of the invention, the head and torso are preferably represented by a first bag, the arms are represented by second and third bags, and the legs are preferably represented by a fourth bag. Each of the component decorative bags is formed of a flexible waterproof material having at least one initially open end. The initially open end is for receiving filler material such as crumpled sheets of paper, foam "peanuts", leaves, empty beverage containers, or other refuse. The shape and size of the head/torso bag is preferably chosen and the presealed end of the head/torso bag is arranged such that a head portion of the head/torso bag assumes a generally spherical shape of appropriate size when filled with filler material and a torso portion of the head/torso bag assumes a generally ovoid shape of appropriate size when filled with filler material. The size and shape of the two arm bags are chosen, and the presealed end of the bags are arranged such that the arm bags assume a generally elongate cylindrical shape of appropriate size when filled with filler material. The shape and size of the legs bag is chosen, such that the legs bag assumes a generally elongate cylindrical shape and the size of two legs when filled with filler material. Preferably the legs "bag" has two initially open ends. Closing means are provided for closing the initially open ends of the component bags.

The respective bags are preferably made of an inelastic, thin, flexible plastic material, such as the material from which plastic leaf or garbage bags are made. At least the major portion of the outside surface of each bag in the assembly is preferably provided with coloration relevant to the figure represented, the holiday or festival being celebrated, and/or the purpose or occasion served by the decoration. For example, the major portion of the PUMPKIN-MAN is preferably colored orange and black. Indicia are also provided on the outside surface of each bag in the assembly to further decorate and supply basic and fanciful detail to the figures. For example, the PUMPKIN-MAN includes indicia representative of a jack o'lantern on the head portion of the head/torso bag, a plaid shirt and suspenders on the torso portion of the head/torso bag, and pant legs on the legs bag.

The figure may be assembled by filling the head/torso, arm, and legs bags with filler material, i.e. leaves, foam "peanuts", paper, or empty beverage containers. The bags are then closed and clipped, tied or otherwise fastened together with the head portion of the head/torso bag oriented on top of the torso portion, the arm bags fastened to the upper position of the torso portion, and the legs bag attached to the lower portion of the torso bag to provide a decorative simulation of a PUMPKIN-MAN. The figure can be erected indoors or outdoors. The figure can also be posed in various positions as a result of articulable appendages. Furthermore, the figure can also be outfit with clothing, hats and other accessories.

Additional objects and advantages of the invention will become apparent to those skilled in the art upon reference to the detailed description taken in conjunction with the provided figures.

BRIEF DESCRIPTION OF THE DRAWINGS

FIGS. 4(A)–(B) show closure means for use in the present invention;

FIGS. 5 shows details of the means of assembly of the combination of the present invention shown in FIG. 1;

DETAILED DESCRIPTION OF THE PREFERRED EMBODIMENTS

Figure 2:
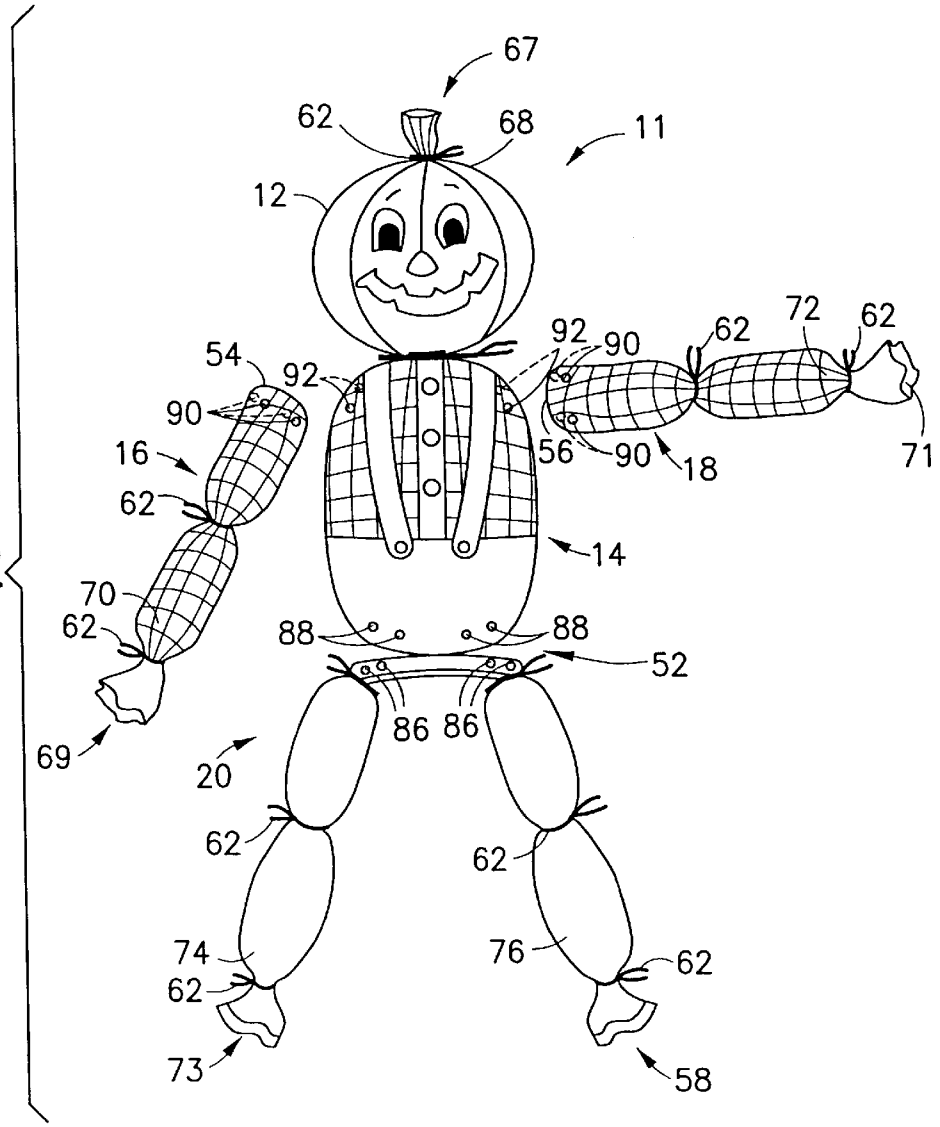
FIG. 2 provides an exploded view showing the components of the combination of FIG. 1 in separated form.
Figure 1:
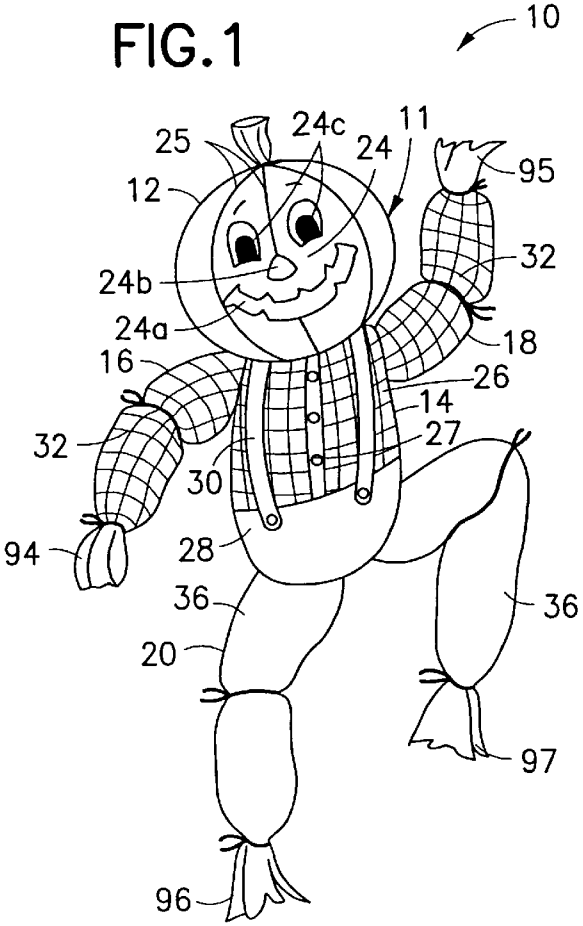
FIG. 1 is a perspective view of an embodiment of the decorative combination of the present invention simulating a PUMPKIN-MAN.
Figure 10:
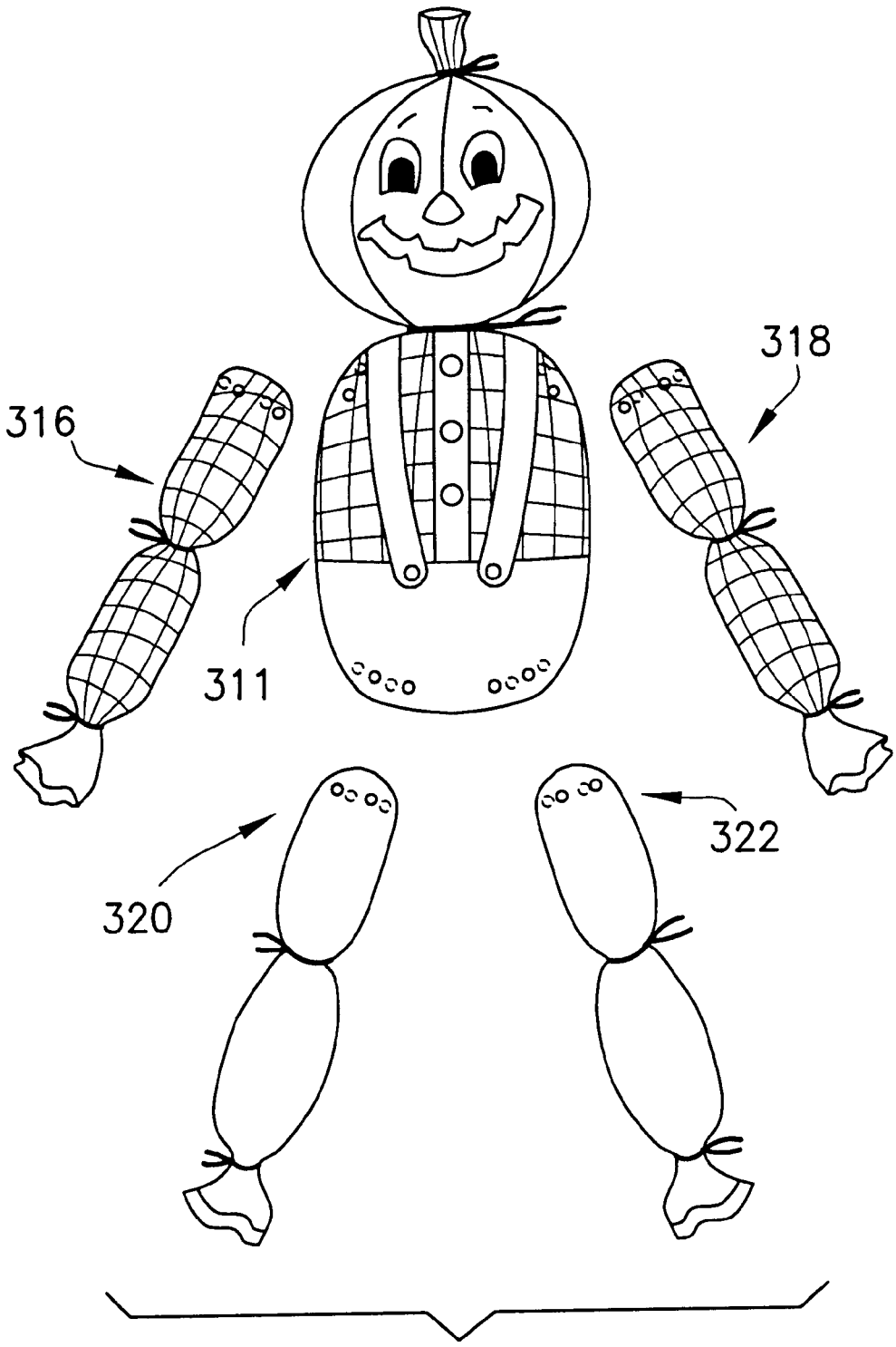
FIG. 10 provides an exploded view of a fourth embodiment of a decorative combination according to the invention.

Turning now to FIGS. 1 and 2, a decorative combination of a posable, human-sized and human proportioned scarecrow with pumpkin head ("PUMPKIN-MAN") decorative FIG. 10 comprises four bags: a head/torso bag 11 having a head portion 12 and a torso portion 14, two arm bags 16, 18, and a legs bag 20. The bags have appropriate holiday coloring, having an orange base color and including black and yellow fanciful indicia. The head portion 12 of the head/torso bag 11 includes jack o'lantern facial indicia 24, while the torso portion 14 of the head/torso bag 11, the arm bags 16, 18 and the legs bag 20 have garment indicia, described in detail below.

Figure 3A:
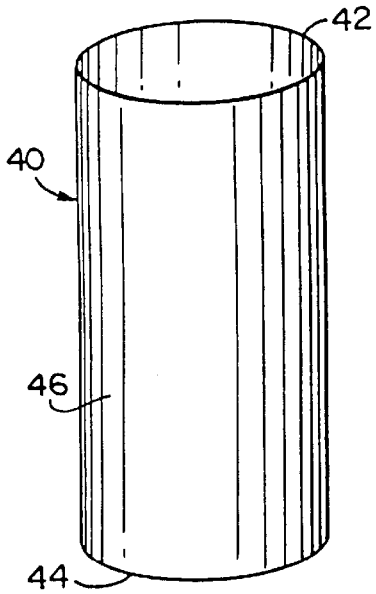
FIGS. 3(A)–3(E) are perspective views of flexible bags that can be used in forming a decorative combination of the present invention.
Figure 3B:
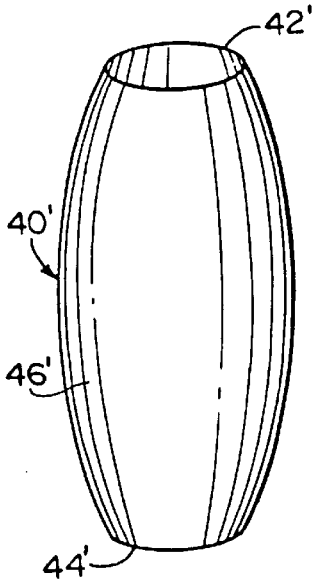
Figure 3C:
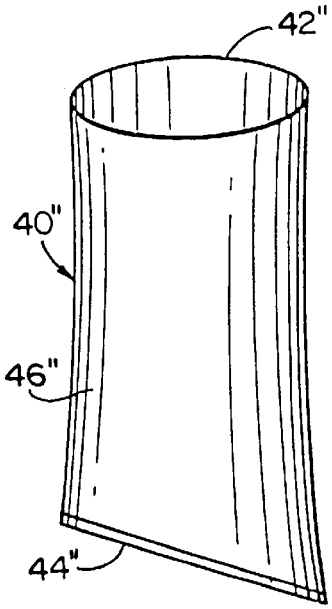
Figure 3D:
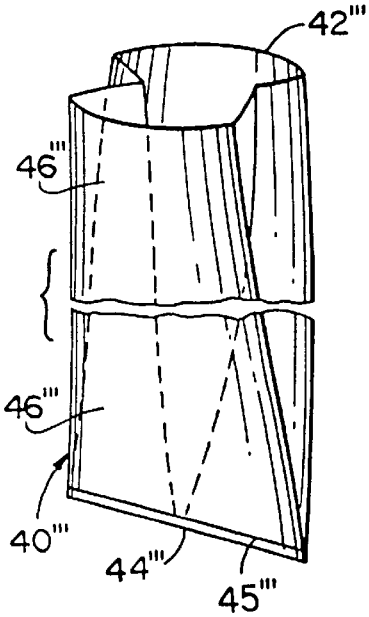
Figure 3E:
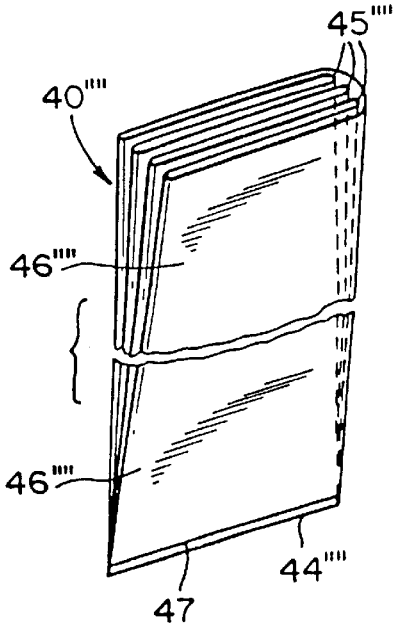

Each bag can be made from any of a numerous flexible bag types, examples of which are shown in FIGS. 3(A)–(E) and described fully in co-owned U.S. Pat. No. 5,458,932, previously incorporated herein. In brief, FIG. 3(A) shows a tubular bag 40 formed in a substantially cylindrical shape from flexible, waterproof plastic material; e.g., the material generally used for trash or leaf bags and suitable for indoor or outdoor use. Although bag 40 is shown having a cylindrical tubular configuration with first and second open ends 42 and 44 and a cylindrical wall 46, and is the preferred configuration for the legs bag 20, the bag 40 may have any other suitable configuration within the scope of the present invention. For example, a convex cylindrical configuration bag 40' as shown in FIG. 3(B) or a conventionally shaped leaf or trash bag 40" as shown in FIG. 3(C) having a closed end and an open end can also be used, as is preferred with respect to the head/torso bag 11 and the arm bags 16, 18. As shown in FIG. 3(C), the closed bottom end 44" is closed by heat sealing. As a further alternative, a conventional gusseted bag 40'", as shown in FIG. 3(D) can be used. As a still further alternative, a bag 40"" (FIG. 3(E)) having a closed bottom end 44"" with a so-called Z-lock, provides a limited bunching effect of the bottom end of the bag when the bag is filled. In any case, the bag 40 has an upper open end 42 and a lower end 44 which may be open as shown in FIGS. 3(A) and 3(B) or which may be closed as shown in FIGS. 3(C), 3(D) and 3(E).

In accordance with one aspect of the present invention, bags 40-40"", when assembled and filled, according to the present invention, assume a substantially ovoid solid form, as shown at 11 in FIG. 2 or substantially cylindrical form, as shown at 16, 18, and 20 in FIG. 2, depending on the length of the cylindrical wall 46-46"" relative to a base side 44-44"". The bags assume their respective shapes as follows. First, one end of each of the four bags 11, 16, 18, 20 unless presealed, is sealed by any suitable means, e.g. heat sealing, or twist tie means, etc., so as to form first closed ends 52, 54, 56, and 58. Thereafter, the head/torso bag 11 is filled with material, such as leaves, crumpled newspapers, paper scraps, foam "peanuts", empty beverage containers, or other lightweight materials, until the torso portion 14 of the head/torso bag assumes a generally ovoid shape. The head/torso bag 11 is then preferably tied off with a closure means 62 (FIG. 4(A)) to generally separate or distinguish the head portion 12 from the torso portion 14 with a neck region. The head portion 12 is further filled to a generally spherical shape as shown at 12. Alternatively, the head/torso bag is filled completely with filler material and closed with closure means. At the location between the head portion 12 and the torso portion 14, the head/torso bag 11 is crimped with tying means, such as pieces of string or cord, and the tying means are tied. As a result of the tying and crimping, a neck region is located on the head/torso bag 11 between the head portion 12 and the torso portion 14.

The arm bags 16, 18 are each half filled and then closed off with a closure means 62 to form an articulable elbow joint, so that they assume the shape of two elongate cylindrical portions with rounded ends. The legs bag 20 is a fifth filled, closed off with a closure means 62 to form an articulable knee joint, filled a second fifth and closed off with another closure means 62. The third fifth of the bag is left empty and a closure means 62 is used on the other side of the empty fifth to prevent filler material from entering the third fifth. The fourth fifth is filled and closed off with a closure means 62 to form an articulable knee joint, and the bag is filled the final fifth. The open ends 67, 69, 71, 73 of the bags are then closed in a "bunched" manner by use of closure means such as ties 62 of FIG. 4(A) or flexible barbed straps 64 of FIG. 4(B), or a clamp or rubber band, or the like, so as to form tied together or bunched, generally rounded closed ends or portions 68, 70, 72, 74, 76 as shown in FIG. 2.

Alternatively, the arm bags 16, 18 may be filled completely and closed with closure means. At the midpoint of the length of the arm bags 16, 18, the bags are crimped with tying means, such as pieces of string or cord, and the tying means are tied. As a result of the tying and crimping, elbow joint regions are located on the arm bags. Additionally, the legs bag may be filled two-fifths, closed with closure means, the adjacent fifth or so closed off in an empty state, and the remaining two-fifths filled an closed with closure means. At the midpoint of each filled two-fifths portion, the bag is crimped with tying means, such as pieces of string or cord, and the tying means are tied. As a result of the tying and crimping, knee joint regions are located on the legs bag. The joint locations enable the arm and legs bags to be articulated into a desired position.

As mentioned above, each of the bags shown in FIGS. 1 and 2 preferably has indicia on its front and back outer surface to simulate the appearance of a PUMPKIN-MAN. Thus, facial indicia 24 can be provided separately or printed on the head portion 12 of the head/torso bag. For example, as shown in FIG. 1, the facial indicia may include a yellow mouth 24*a*, a yellow nose 24*b*, and black and yellow eyes 24*c*, wherein the yellow represents the glow from a candle burning inside a carved pumpkin. The head portion 12 may also include arced longitudinal black lines 25 which represent the natural contours of a pumpkin. The torso portion 14 may include black indicia of a plaid shirt 26, buttons 27, a pant portion 28, and suspenders 30. The arm bags 16, 18 include black indicia of plaid shirt arms 32. The legs bag 20 include black indicia of pant legs 36. Preferably, the indicia are preprinted on the outer surface of the bags. Alternatively, the facial indicia 24 are "self-stick" adhesive backed members easily applyable to the head/torso bag 11. Likewise, the other indicia for the other bags may alternatively be provided as self-stick adhesive backed members.

In the decorative combination of the PUMPKIN-MAN of the present invention, outdoor-type bags are preferred as part of the bag assembly. By way of example, and not by way of limitation, the head/torso bag 11 (unfilled) may be about seventy-five inches tall by twenty-four inches wide (forming an approximately fifteen inch spherical head portion 12 and a relatively larger ovoid torso portion 14), with the pant portion indicia extending approximately thirteen inches up from the bottom of the bag and with the shirt indicia extending upward from the pant portion indicia to the head portion 12 of the bag; the arm bags 16, 18 (unfilled) may be about thirty-five inches in length by eight and a half inches in width with the shirt indicia extending from the closed end to approximately six inches from the open end; and the legs bag 20 (unfilled) may be about seventy-five inches in length by eight and a half inches in width with the pant indicia extending from approximately six inches from one end to approximately six inches from the other end. After the arm and legs bags are assembled, the portions of the arm and legs bags which have no indicia can be shred to simulate straw 94, 95, 96, 97 extending from the arms and legs of the figure (see FIG. 1). Alternatively, the same portions can be printed with indicia to resemble straw, and then cut or left uncut. It will be appreciated that each of the provided bags preferably have corresponding indicia on back sides, not visible in FIGS. 1 and 2.

As discussed above, closure means are desirable for closing the stuffed bags 11, 16, 18, 20. Closure means may include a conventional twist tie 62, shown at FIG. 4(A), which comprises a flexible wire 78 embedded in flexible plastic 79 or paper. An alternative closure means is shown at 64 in FIG. 4(B) formed of a flexible plastic strap 80 with barbs 81 which engage the strap when the tapered end 82 of thereof is threaded through opening 83. The closure means may also be pre-coupled to the bags prior to filling the bags. For example, drawstring bags, e.g., the type sold under the tradename Cinchsack™ by Hefty, in which a drawstring is cinched to close an opening in the bag, or bags having removable or partially removable plastic strips coupled to the bag by a perforate seam around an opening bag; i.e., the strip is at least partially decoupled from the bag and used to tie the bag closed, may be used. These types of closure means are commercially available and are shown only by way of example, as other ties or closure means can be used.

It will be appreciated that any suitable dimensions and material can be used with bags 40-40"". However, in a typical embodiment, it is preferred that all of the bags be made of polyethylene or a similar waterproof material having a thickness in the range of about 0.5–5 mils, with a preferred thickness of about 1.3 mils.

The bags are assembled to one another by coupling means. The coupling means may be the same as the closure means, i.e., conventional twist tie closures, or the bags may be coupled by the use of staples. Using twist ties, the structure of the present invention is assembled as shown in FIG. 5. In particular, holes 86 are punched into the empty portion of the otherwise filled legs bag. Holes 88 are also punched into opposing side walls of the lower portion of the torso portion 14 of the head/torso bag 11. Each leg is coupled to one side of the lower portion of the torso portion by weaving a relatively long conventional tie 62 through the holes in the legs bag and the holes in the torso portion of the head/torso bag. Once the ties have been weaved through the holes 86, 88, the ties are twisted such that they secure the leg bag 20 to the head/torso bag 11. Referring back to FIG. 2, likewise, holes 90 are punched into the top of the arm bags 16, 18 and holes 92 are also punched into opposing side walls (analogous to shoulder areas) of the torso portion 14 of the head/torso bag 11. In the same manner as the legs bag is coupled to the torso portion 14, each arm bag is coupled to one of the shoulder areas by weaving conventional ties through the holes 90 in the arm bags and the holes 92 in the shoulder areas of the torso portion 14. It will be appreciated that holes can be already provided in the bags, eliminating the need for punching the holes during assembly.

Figure 6A:
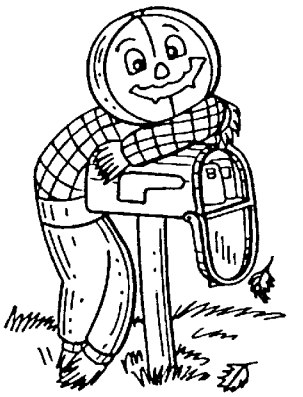
FIGS. 6(A)–(G) illustrate the articulacy of the appendages of the embodiment of the invention shown in FIG. 1 and several positions in which the same embodiment can be posed.
Figure 6B:
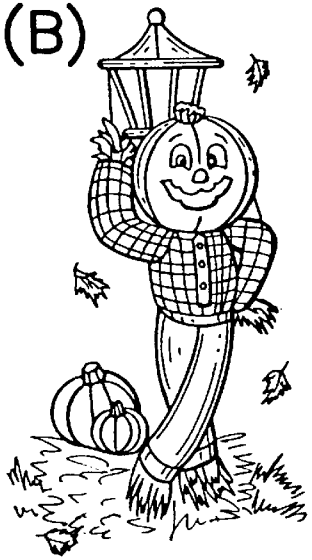
Figure 6C:
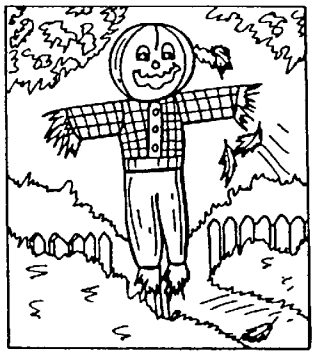
Figure 6D:
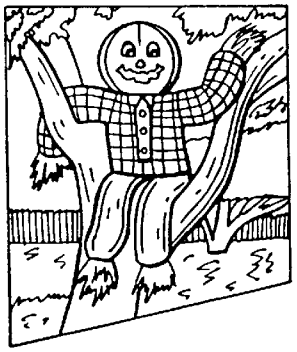
Figure 6E:
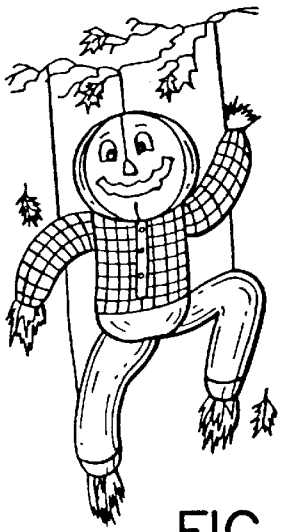
Figure 6F:
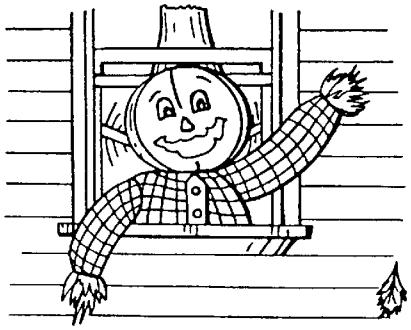
Figure 6G:
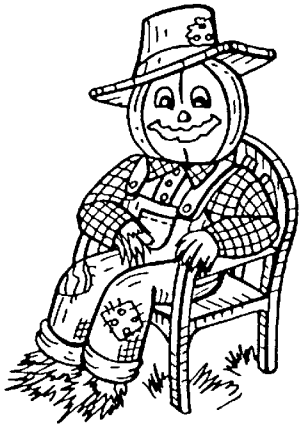

Referring to FIGS. 6(A)–(F), once assembled, the PUMPKIN-MAN figure can be posed in a variety of positions and/or dressed in clothing. For example, and not by way of limitation, the figure may be propped and secured against a support in a leaning position (FIG. 6(A)) or in a standing position (FIG. 6(B)). The figure may also be configured as a scarecrow on a pole (FIG. 6(C)). Additionally, due to the articulacy of the elbow and knee joints, the figure may be seated (FIG. 6(D) and 6(G)), suspended from a tree (FIG. 6(E)) or placed into many other positions permissible by articulating joints. Furthermore, the figure may be propped at a window, partially extending outdoors (FIG. 6(F)), or situated entirely indoors as an indoor decorative display (not shown). Common cord may be use to secure the figure to a support or to suspend the figure from a tree. In addition, since the figure is preferably of human size and proportion, the figure may be dressed in human clothing (FIG. 6(G)), fit with hats (also FIG. 6(G)), and/or outfit with accessories (not shown).

Figure 7:
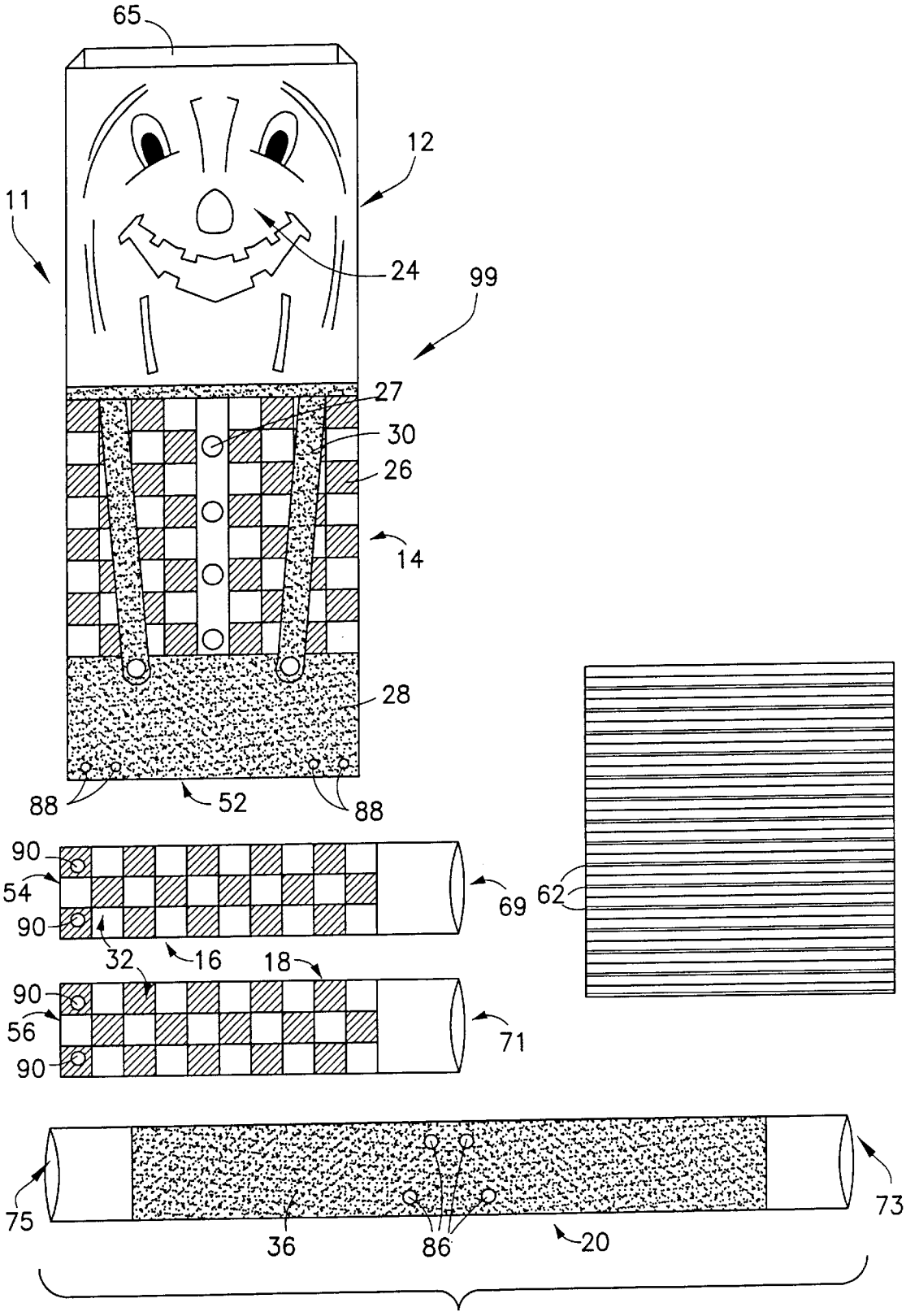
FIG. 7 illustrates a kit for a decorative combination of the present invention as shown in FIG. 1.

In a preferred aspect of the invention, a kit 99 for the combination of a PUMPKIN-MAN is shown in FIG. 7 and comprises at least four flexible bag members 11, 16, 18, and 20 which are preferably of sizes relational to the different sizes hereinabove described, and a plurality of closure means and coupling means such as ties 62. The head/torso bag 11 is preferably a Z-lock type gussetted bag, having a heat sealed closed end 52, an open end 65, jack o'lantern indicia 24, and garment indicia 26, 27, 28, 30. The arm bags 16, 18 include a closed heat sealed end 54, 56, an open end 69, 71, and garment indicia 32. The legs bag 20 include two open ends 73, 75 and is black over a majority of the bag to represent a pant leg 36. A plurality of closure means are provided for closing the open ends of the bags and for forming joints. A plurality of coupling means are also provided for attaching the arm and legs bags to the head/torso bag. Preferably, directions are supplied with the kit which indicate where to punch holes through which to thread the coupling means. Alternatively, holes 86, 88, 90 (, 92) are provided in the various bags indicating where coupling means should be weaved through the various bags to assist in assembly. As a further alternative, indicia are printed on the various bags indicating where holes may be poked through the bag so that the coupling means may be weaved through the bags in the assembly, or no holes or hole indicia are provided and the kit assembler can determine the locations for weaving the bags together. It should also be recognized that the holes can be located or indicia for holes may be indicated at positions other than as shown in FIG. 7.

Figure 9:
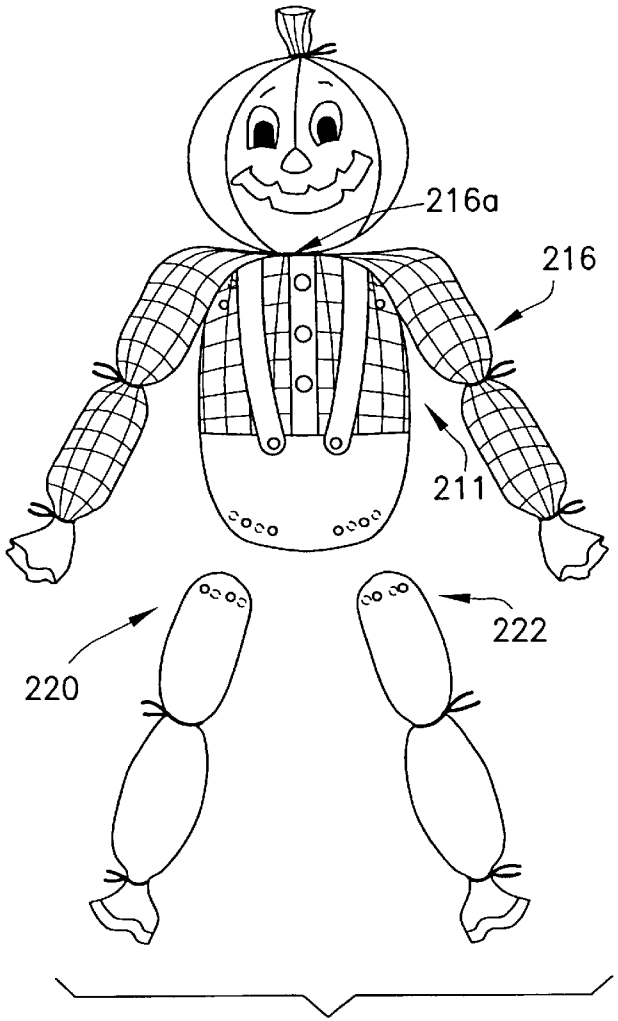
FIG. 9 provides an exploded view of a third embodiment of a decorative combination according to the invention.
Figure 8:
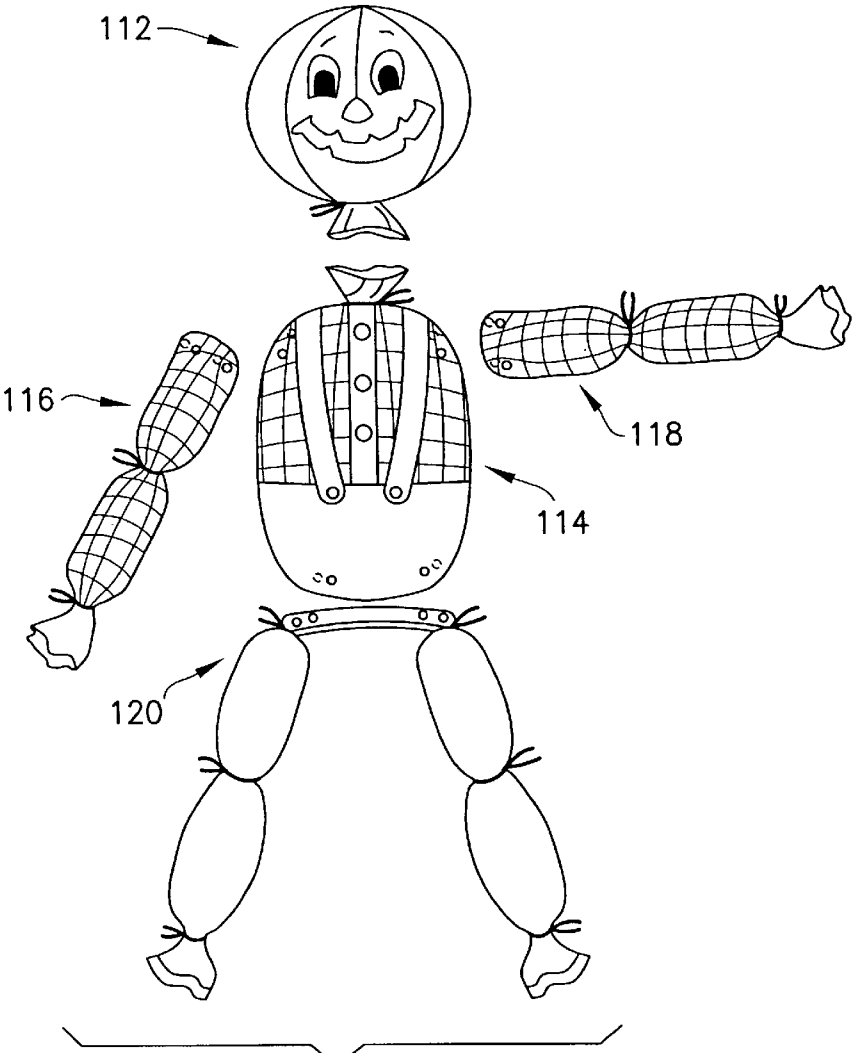
FIG. 8 provides an exploded view of a second embodiment of a decorative combination according to the invention.

Other embodiments, substantially similar to the first embodiment, (with like parts having numbers incremented by a multiple of 100) may also be provided, as shown in FIGS. 8 through 10. Referring to FIG. 8, the head and torso of the figure may be formed from distinct head and torso bags, 112 and 114, respectively (as described in detail in the parent application), the arms may be formed from distinct arm bags 116, 118, and the legs may be formed from a single legs bag 120. Referring to FIG. 9, the legs may be formed from two distinct leg bags 220, 222, each corresponding to one of the figures legs (as further described in the parent application). In addition, the two arms may be formed from a single arms bag 216 which can be attached to the torso portion of the head/torso bag (or to a shoulder portion of a torso bag if separate head and torso bags are used). A single arms bags, when filled, preferably has an empty central portion 216*a* which can be wrapped around the "neck" of a filled head/torso bag 211 or which may be coupled to the back of the torso portion of the head and torso bag such that the arms reside in a generally anatomically correct position. Referring to FIG. 10, the figure may have a head portion and a torso portion formed from a single head/torso bag 311, and the arms and legs may be formed from two distinct arm bags 316, 318 and two distinct leg bags 320, 322, respectively. It will be appreciated the kit 99 may be provided with any combination of the above bag configurations such that a costumed human-like figure is or can be formed.

There have been described and illustrated herein a costumed human-like figure assembled from several bag components. While particular embodiments of the invention have been described, it is not intended that the invention be limited thereto, as it is intended that the invention be as broad in scope as the art will allow and that the specification be read likewise. Thus, while a PUMPKIN-MAN has been disclosed, it will be appreciated that other seasonal, festive, holiday, and non-holiday figures can likewise be made from similar components having different indicia. For example, and not by way of limitation, a scarecrow, Santa Claus, Easter Bunny, a pilgrim, and mannequins in male and female form, each of which are disclosed in parent application Ser. No. 08/653,759, and an Uncle Sam, Mrs. Claus, Dracula, Frankenstein's monster, a witch, a skeleton, a mummy, a leprechaun, an elf, a farmer, a farmer's wife, historical figures (e.g. Abraham Lincoln, Mark Twain, etc.), cartoon characters, and famous celebrity likenesses can likewise be assembled or supplied in kit form. Also, while the figure has been disclosed to be human-sized and human-proportioned, it will be appreciated that the figure need not be both human-sized and human-proportioned. In particular, the figure may be human-sized and not human-proportioned (as in a human-sized PUMPKIN-MAN having an oversized head) or the figure may be human-proportioned and not human-sized (for example, a humanized Easter Bunny substantially larger than a human). Furthermore, while particular coupling means for assembling the figure have been disclosed, it will be understood that other coupling means can be used, as discussed in previously incorporated co-owned U.S. Pat. No. 5,458,932. Moreover, while particular types and sizes of bags have been disclosed, other bag types and sizes can also be utilized. It will also be understood that the bags, as shown in the drawings, may be reversed, whereby the location of the open end and the sealed end with respect to the indicia are reversed. For example, where any of the bags is shown to have a sealed end adjacent the head/torso bag, it will be appreciated that the bags can be printed with indicia such that the bags will be correctly configured when the sealed ends are opposite the torso bag, and vice versa. Furthermore, the head/torso bag can be printed in reverse such that the sealed end of the head/torso bag such that the initially open end is either on the head portion or the torso portion. It will therefore be appreciated by those skilled in the art that yet other modifications could be made to the provided invention without deviating from its spirit and scope as so claimed.

I claim:

1. A kit for making a decorative figure for use with a non-fluid filling material including leaves or newspapers, said kit comprising:

a) a non-elastic plastic head and torso bag having an open end and which when filled with a first portion of the non-fluid filling material will assume the form of a human head and torso;

b) at least one non-elastic plastic arm bag having an open end and which when filled with a second portion of the non-fluid filling material will assume the form of at least two human arms;

c) at least one non-elastic plastic leg bag having an open end and which when filled with a third portion of the non-fluid filling material will assume the form of at least two human legs;

d) a plurality of closure means for closing said open ends of said head and torso bag, said at least one arm bag, and said at least one leg bag;

e) constricting means for constricting a portion of said head and torso bag to define separate head and torso portions of said head and torso bag, wherein said open end of each of said head and torso bag, said at least one arm bag, and said at least one leg bag is sufficiently wide to permit said bags to be filled with the non-fluid filling material including leaves or newspapers, and said bags, once filled, are assemblable into a figure proportioned to and resembling a costumed human.

2. A kit according to claim 1, further comprising:

e) first coupling means for coupling said at least one arm bag and said at least one leg bag to said head and torso bag.

3. A kit according to claim 1, where in:

at least one of said plurality of closure means also constitutes a coupling means for coupling said at least one arm bag and said at least one leg bag to said head and torso bag.

4. A kit according to claim 1 wherein:

said head and torso bag, said at least one arm bag, and said at least one leg bag are made of a flexible, waterproof material.

5. A kit according to claim 1, wherein:

two human arms and said two human legs are human-proportioned.

6. A kit according to claim 1, further comprising:

e) fanciful indicia on at least one of said head and torso bag, said at least one arm bag, and said at least one leg bag.

7. A kit according to claim 6, wherein:

said head and torso bag includes fanciful pumpkin indicia.

8. A kit according to claim 1, wherein:

said head and torso bag, said at least one arm bag, and said at least one leg bag include fanciful garment indicia.

9. A kit for making a decorative figure for use with a non-fluid filling material including leaves or newspapers, said kit comprising:

a) a non-elastic plastic head bag having an open end and which when filled with a first portion of the non-fluid filling material will assume the form of a human head;

b) a non-elastic plastic torso bag having an open end and which when filled with a second portion of the non-fluid filling material will assume the form of a human torso;

c) at least one non-elastic plastic arm bag having an open end and which when filled with a third portion of the non-fluid filling material will assume the form of two human arms;

d) at least one non-elastic plastic leg bag having an open end and which when filled with a fourth portion of the non-fluid filling material will assume the form of two human legs; and e) a plurality of closure means for closing said open ends of said head and torso bag, said at least one arm bag, and said at least one leg bag, wherein said open end of each of said head bag, said torso bag, said at least one arm bag, and said at least one leg bag is sufficiently wide to permit said bags to be filled with the non-fluid filling material including leaves or newspapers, and said bags, once filled, are assemblable into a figure proportioned to and resembling a costumed human.

10. A kit according to claim 9, further comprising:

f) first coupling means for coupling said head bag and said at least one leg bag to said torso bag.

11. A kit according to claim 9, wherein:

at least one of said plurality of closure means also constitutes a coupling means for coupling said head bag and said at least leg bag to said torso bag.

12. A kit according to claim 9, wherein:

said head bag, said torso bag, said at least one arm bag, and said at least one leg bag are made of a flexible, waterproof material.

13. A kit according to claim 9, wherein:

said two human arms and said two human legs are human-proportioned.

14. A kit according to claim 9, further comprising:

f) fanciful indicia on at least one of said head bag, said torso bag, said at least one arm bag, and said at least one leg bag.

15. A kit according to claim 14, wherein:

said head bag includes fanciful pumpkin indicia.

16. A kit according to claim 9, wherein:

said torso bag, said at least one arm bag, and said at least one leg bag include fanciful garment indicia.

17. A decorative figure assembly, comprising:

a) a non-fluid filling material;

b) a plurality of individual closure means each for closing a bag;

c) a constricting means for constricting a portion of a bag;

d) a plastic head and torso bag containing a first portion of said filling material and having an open end being closed by a first of said plurality of closure means, and constricted by said constricting means at a location to define separate head and torso portions of said head and torso bag;

e) at least one plastic arm bag containing a second portion of said filling material and having an open end being closed by a second of said plurality of closure means, said at least one arm bag defining two arms;

f) at least one plastic leg bag containing a third portion of said filling material and having an open end being closed by a third of said plurality of closure means, said at least one leg baa defining two legs; and g) a plurality of coupling means for coupling said head and torso bag to said at least one arm bag and to said at least one leg bag, wherein said at least one arm bag and said at least one leg bag are coupled by said plurality of coupling means to said head and torso bag and form a figure proportioned to and resembling a costumed human.

18. A decorative figure assembly according to claim 1, wherein:

said decorative figure is substantially adult human-sized.

19. A decorative figure assembly according to claim 1, wherein:

said at least one arm bag forms first and second arms of said decorative figure assembly and said at least one leg bag is exactly one leg bag which forms first and second legs of said decorative figure assembly.

20. A decorative figure assembly according to claim 1, wherein:

said head and torso bag said at least one arm bag, and said at least one leg bag are made of a flexible, waterproof material.

21. A decorative figure assembly according to claim 1, wherein:

exactly two arm bags are provided, each containing some of said second portion of said filling material and having an open end being closed by said second and a fourth of said plurality of closure means.

22. A decorative figure assembly according to claim 1, wherein:

exactly two leg bags are provided, each containing some of said third portion of said filling material and having an open end being closed by said third and a fourth of said plurality of closure means.

23. A decorative figure assembly according to claim 21, wherein:

exactly two leg bags are provided, each containing some of said third portion of said filling material and having an open end being closed by said third and a fifth of said plurality of closure means.

24. A decorative figure assembly according to claim 1, further comprising:

g) fanciful indicia on at least one of said head and torso bag, said at least one arm bag, and said at least one leg bag.

25. A decorative figure assembly according to claim 24, wherein:

said head and torso bag includes a head portion provided with fanciful pumpkin indicia.

26. A decorative figure assembly according to claim 25, wherein:

said head and torso bag, said at least one arm bag, and said at least one leg bag include fanciful garment indicia.

27. A decorative figure assembly according to claim 1, wherein:

said at least one arm bag and said at least one leg bag have articulating joint portions.

28. A decorative figure assembly, comprising:

a) a non-fluid filling material;

b) a plurality of individual closure means each for closing a bag;

c) a plastic head bag containing a first portion of said filling material and having an open end being closed by a first of said plurality of closure means;

d) a plastic torso bag containing a second portion of said filling material and having an open end being closed by a second of said plurality of closure means;

e) at least one plastic arm bag defining first and second arms, said at least one arm bag containing a third portion of said filling material and having an open end being closed by a third of said plurality of closure means;

f) at least one plastic leg bag defining first and second legs, said at least one lea bag containing a fourth portion of said filling material and having an open end being closed by a fourth of said plurality of closure means; and g) a plurality of coupling means for coupling said torso bag to said head bag, to said arm bags, and to said leg bags, wherein said arm bag and said leg bag are coupled by said plurality of coupling means to said head and torso bag and form a figure proportioned to and resembling a costumed human wearing a mask.

29. A decorative figure assembly according to claim 28, wherein:

said decorative figure is substantially adult human-sized.

30. A decorative figure assembly according to claim 28, wherein:

said at least one arm bag forms first and second arms of said decorative figure assembly and said at least one leg bag is exactly one leg bag which forms first and second legs of said decorative figure assembly.

31. A decorative figure assembly according to claim 28, wherein:

said torso bag, said head bag, said at least one arm bag, and said at least one leg bag are made of a flexible, waterproof material.

32. A decorative figure assembly according to claim 28, wherein:

exactly two arm bags are provided, each containing some of said third portion of said filling material and having an open end being closed by said third and a fifth of said plurality of closure means.

33. A decorative figure assembly according to claim 28, wherein:

exactly two leg bags are provided, each containing some of said fourth portion of said filling material and having an open end being closed by said fourth and a fifth of said plurality of closure means.

34. A decorative figure assembly according to claim 28, further comprising:

h) fanciful indicia on at least one of said head bag, said torso bag, said at least one arm bag, and said at least one leg bag.

35. A decorative figure assembly according to claim 34, wherein:

said head bag is provided with fanciful pumpkin indicia.

36. A decorative figure assembly according to claim 35, wherein:

said torso bag, said a t least one arm bag, and said at least one leg bag include fanciful garment indicia.

37. A decorative figure assembly according to claim 28, wherein:

said at least one arm bag and said at least one leg bag have articulating joint portions.

* * * * *